US006655279B2

(12) United States Patent
Tsukamoto

(10) Patent No.: US 6,655,279 B2
(45) Date of Patent: Dec. 2, 2003

(54) ROLL SUPPORT STRUCTURE OF PRINTING DEVICE

(75) Inventor: Katsuhide Tsukamoto, Tokyo (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 10/259,645

(22) Filed: Sep. 30, 2002

(65) Prior Publication Data

US 2003/0061956 A1 Apr. 3, 2003

(30) Foreign Application Priority Data

Oct. 1, 2001 (JP) ..... 2001-304817

(51) Int. Cl.[7] ..... B41F 31/00

(52) U.S. Cl. ..... 101/350.1; 101/367; 101/479; 101/216; 101/375

(58) Field of Search ..... 101/479, 348, 101/349.1, 350.1, 351.2, 352.1, 363.1, 364, 367, 216, 375, 352.13

(56) References Cited

U.S. PATENT DOCUMENTS 3,613,578 A * 10/1971 Heurich ..... 101/352.13
4,901,641 A * 2/1990 Steiner et al. ..... 101/350.1
5,088,407 A * 2/1992 Helm et al. ..... 101/363
5,129,319 A * 7/1992 Umetsu ..... 101/216
5,490,458 A * 2/1996 Stuart ..... 101/375
5,570,634 A * 11/1996 Harter ..... 101/375
6,186,065 B1 * 2/2001 Kersch et al. ..... 101/216
6,520,082 B1 * 2/2003 Goldburt et al. ..... 101/350.1
6,530,319 B1 * 3/2003 Elkis et al. ..... 101/479
6,543,356 B2 * 4/2003 Göttling et al. ..... 10/463.1

FOREIGN PATENT DOCUMENTS

GB 985810 3/1965

* cited by examiner

*Primary Examiner*—Eugene H. Eickholt
(74) *Attorney, Agent, or Firm*—Lowe Hauptman Gilman & Berner LLP

(57) ABSTRACT

An anilox roll 15 is disposed such that an outer peripheral surface thereof contacts an outer peripheral surface of a fountain roll 13 positioned in an ink pan 11. Ink I transferred to the outer peripheral surface of the anilox roll 15 is transferred to a plate cylinder 16, and predetermined printing is performed on printing paper P passing between the plate cylinder 16 and a platen 17. One end side of a support shaft 20 of the fountain roll 13 and the anilox roll 15 is removably coupled to a rotating shaft 32 via coupling means 29, and the other end side of the support shaft 21 is supported by urging means 59. The urging means 59 includes a moving shaft 45 that is movable in the axial direction. Moving the moving shaft 45 permits removal of the fountain roll 13 and/or the anilox roll 15.

4 Claims, 5 Drawing Sheets

ROLL SUPPORT STRUCTURE OF PRINTING DEVICE

BACKGROUND OF THE INVENTION

1. Field of the Invention

The invention relates to a roll support structure of a printing device. More particularly, the invention relates to a roll support structure of a printing device, which allows a fountain roll and the like to be attached and removed with little effort, and which can respond to a change in printing conditions without difficulty.

2. Description of the Related Art

In a known flexographic press, a plurality of printing devices is disposed along the direction in which printing paper is fed. Each printing device transfers ink of a different color to printing paper, whereby polychromic printing is performed. Each printing device includes an ink pan, a fountain roll disposed such that an outer peripheral surface thereof faces the interior of the ink pan, an anilox roll contacting the outer peripheral surface of the fountain roll, a plate cylinder to which ink is transferred via the anilox roll, and a platen that faces the plate cylinder. Printing paper is supplied and fed between the plate cylinder and the platen, whereby predetermined printing is performed on the printing paper.

A gear is provided on one end side of each of support shafts of the above-mentioned fountain roll and the anilox roll. The gears on both the support shafts constitute an interlocking mechanism. One of the gears is engaged with a gear fixed to an output shaft of drive means including a motor and the like. Thus, when the motor rotates, the fountain roll and the anilox roll are interlocked with each other so that they can be rotated.

However, when the fountain roll is replaced by another fountain roll for changing the color of the ink filled in the ink pan, the above-mentioned gear needs to be removed from the support shaft. Thus, there is the inconvenience that an extensive operation is required. In addition, when the density of the plate for printing is changed, the anilox roll needs to be replaced by another anilox roll whose outer peripheral surface has a different finishing accuracy. In this case as well, there is the inconvenience that similar extensive operation is required.

These inconveniences result from use of the single motor constituting a drive source, and the mutual interlocking mechanism including the gear group transmitting the driving power of the motor.

SUMMARY OF THE INVENTION

In view of the above-mentioned inconveniences, it is an object of the present invention to provide a roll support structure of a printing device, which allows a fountain roll and the like to be replaced very easily and quickly, thereby facilitating roll replacement or maintenance and checking.

In order to achieve the above-mentioned object, the present invention provides a roll support structure of a printing device including a fountain roll disposed such that an outer peripheral surface thereof faces the interior of an ink pan, an anilox roll disposed so as to contact the outer peripheral surface of the fountain roll, a plate cylinder to which ink transferred to the anilox roll is transferred, and a platen disposed to face the plate cylinder.

The roll support structure of the printing device has a construction in which one end side of a support shaft of the above-mentioned fountain roll and/or the anilox roll is removably coupled to a rotating shaft for transmitting a predetermined rotating force, while the other end side thereof is supported via urging means that is movable in the axial direction. In this construction, the fountain roll and/or the anilox roll can be attached and removed very easily. Accordingly, when the color of the ink is changed, or when the roll is replaced by another roll for changing the printing accuracy, the efficiency of the operation can be significantly improved.

In the present invention, the construction may be such that one end side of the above-mentioned support shaft and the above-mentioned rotating shaft are coupled together via coupling means. In the construction, the coupling means includes a first coupling member fixed on the outer periphery of the above-mentioned support shaft, a second coupling member fixed on the outer periphery of the above-mentioned rotating shaft, a coupling hole formed in any one of the first and the second coupling members, and a shaft member which is fixed to the other of the first and the second coupling members, and which is fitted into the above-mentioned coupling hole. Accordingly, when the fountain roll and/or the anilox roll is removed, the coupling can be released by the operation of separating the above-mentioned support shaft and the rotating shaft such that the shaft member is pulled out of the coupling hole.

In addition, it is preferable to employ a construction in which the above-mentioned urging means includes a moving shaft that is movable in the axial direction, and in which the moving shaft and the above-mentioned rotating shaft each have a cone-shaped portion at the tip, which can be fitted in an end surface of the support shaft of the above-mentioned fountain roll and/or the anilox roll. Thus, centering of the fountain roll and the like can be performed with high accuracy.

Furthermore, it is possible to employ a construction in which one end side of the above-mentioned support shaft of the above-mentioned fountain roll and/or the anilox roll is supported by a chuck. In the construction, the fountain roll and the like can be supported at one end side by a scroll chuck which is used in a lathe turning machine and the like. Therefore, the installation cost of the roll support structure can be reduced by employing a construction which uses a versatile existing structure.

DETAILED DESCRIPTION OF PREFERRED THE EMBODIMENT

Hereinafter, an embodiment of the invention will be described with reference to the drawings.

Figure 1:
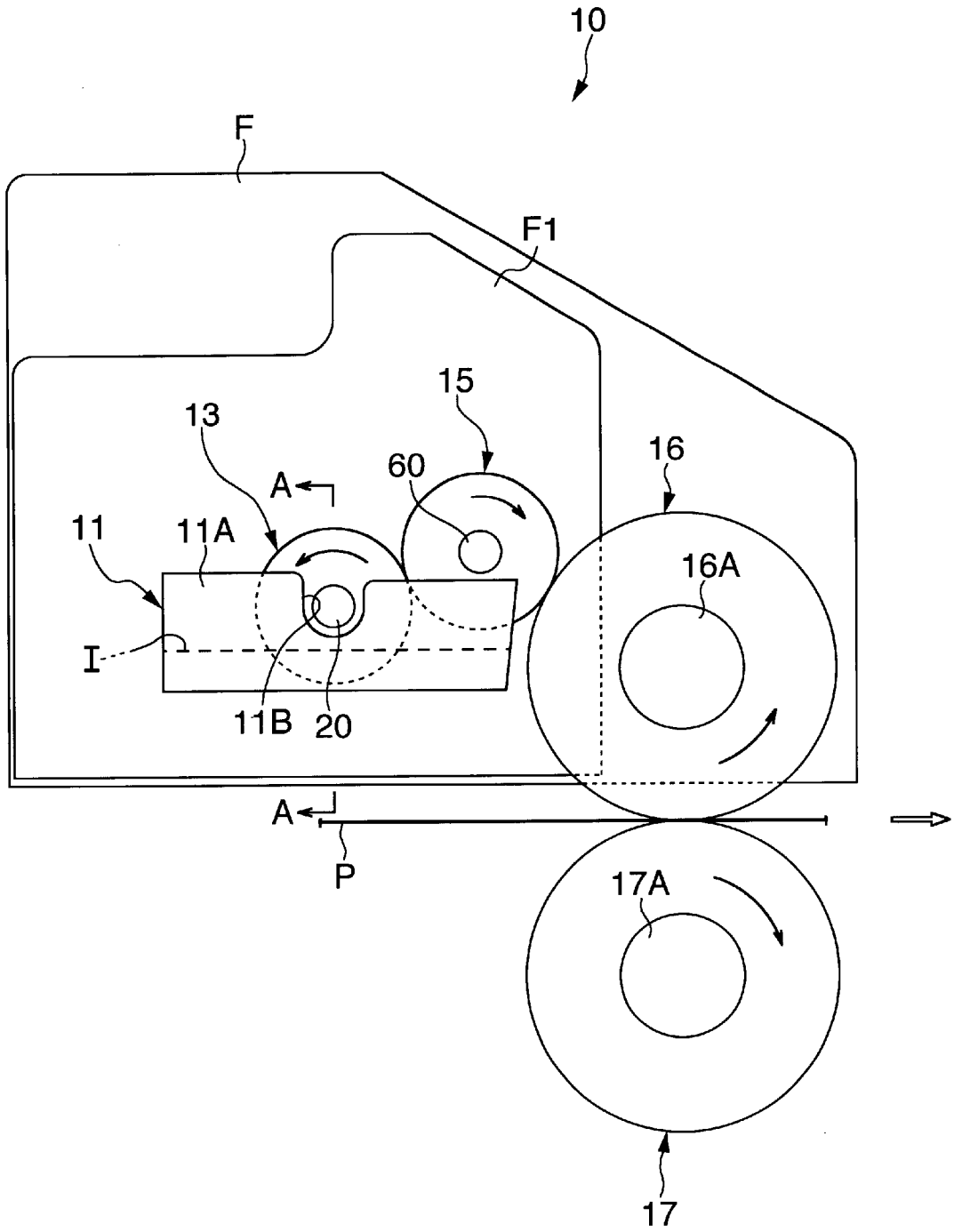
FIG. 1 is a schematic lateral view showing a roll support structure according to an embodiment of the invention.
Figure 2:
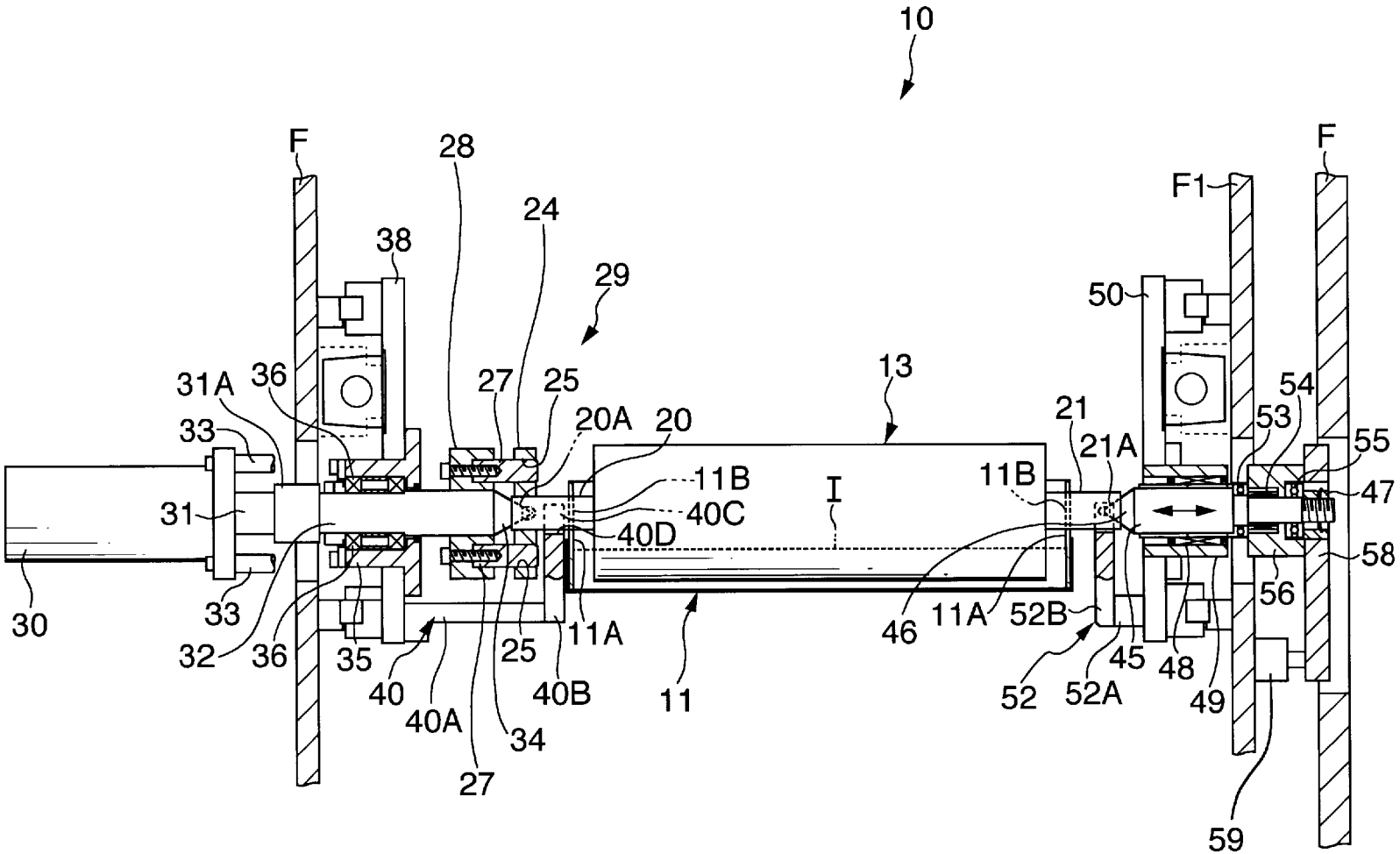
FIG. 2 is a partial cross section view of the roll support structure taken along line A—A.

FIG. 1 is a schematic lateral view showing a printing device of a flexographic press to which the invention is applied. FIG. 2 is a partial cross section view showing the main portion thereof. In these figures, a printing device 10 includes an ink pan 11 disposed between a pair of right and left frames F, F, a fountain roll 13 which faces the inside of the ink pan 11, and which is disposed such that an outer peripheral surface thereof contacts ink I filled in the ink pan 11, an anilox roll 15 disposed so as to contact the outer peripheral surface of the fountain roll 13, a plate cylinder 16 to which ink I transferred to the anilox roll 15 is transferred, and a platen 17 which faces the plate cylinder 16, and which sandwiches printing paper P so that the printing paper P can be fed.

The upper portion of the ink pan 11 is open. A pair of lateral walls 11A, 11A of the ink pan 11 have notch concave portions 11B, 11B at their upper central portions. Both end sides of a support shaft 20, 21 of the fountain roll 13 are positioned in the notch concave portions 11B, 11B.

Figure 3:
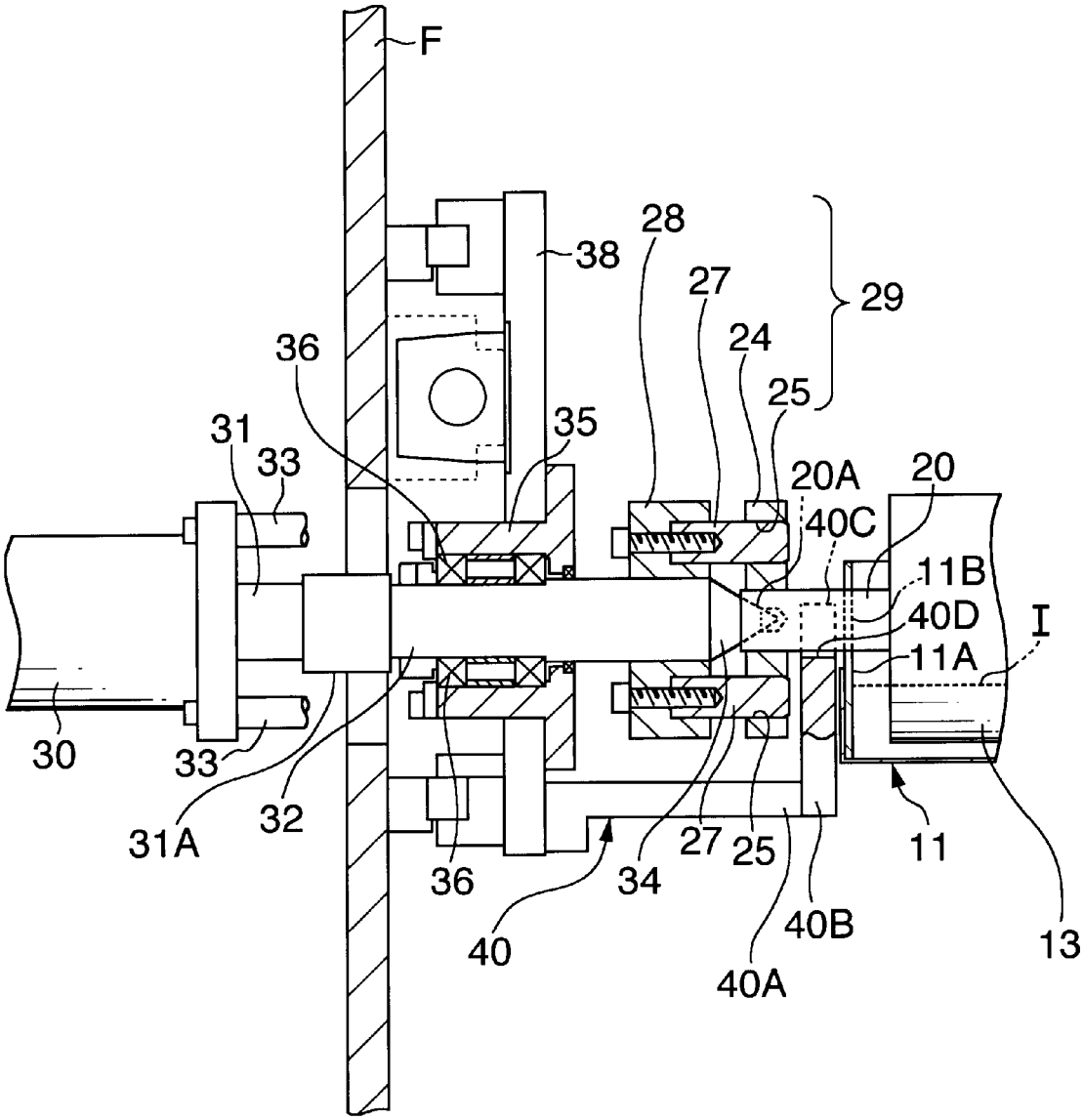
FIG. 3 is an enlarged cross section view of a left side region of FIG. 2.

In the above-mentioned fountain roll 13, a flange 24 (a first coupling member) having a ring plate shape, which constitutes a coupling means 29, is fixed to the outer periphery of one end side of the support shaft 20, i.e., the left side of the support shaft 20 in FIG. 2 and FIG. 3. In the present embodiment, coupling holes 25, 25 are formed in the flange 24 at two locations 180 degrees apart in the circumferential direction, respectively. The coupling holes 25, 25 extend substantially parallel with the axis line of the above-mentioned support shaft 20. Coupling shaft members 27, 27 are provided such that they can be fitted into the coupling holes 25, 25. Each of the coupling shaft members 27, 27 is fixed to a shaft support body 28 (a second coupling member) constituting the coupling means 29. The shaft support body 28 is fixed around a rotating shaft 32 which is coupled to an output shaft 31 of a motor 30 by a coupling 31A. The above-mentioned flange 24, the coupling holes 25, 25, the coupling shaft members 27, 27, and the shaft support body 28 constitute the coupling means 29 for coupling the support shaft 20 to the rotating shaft 32. Note that a cone-shaped portion 34 is provided at the tip of the rotating shaft 32. The cone-shaped portion 34 is fitted in a conical groove 20A formed at the center of the end surface of the above-mentioned support shaft 20 (see FIG. 3).

Figure 4:
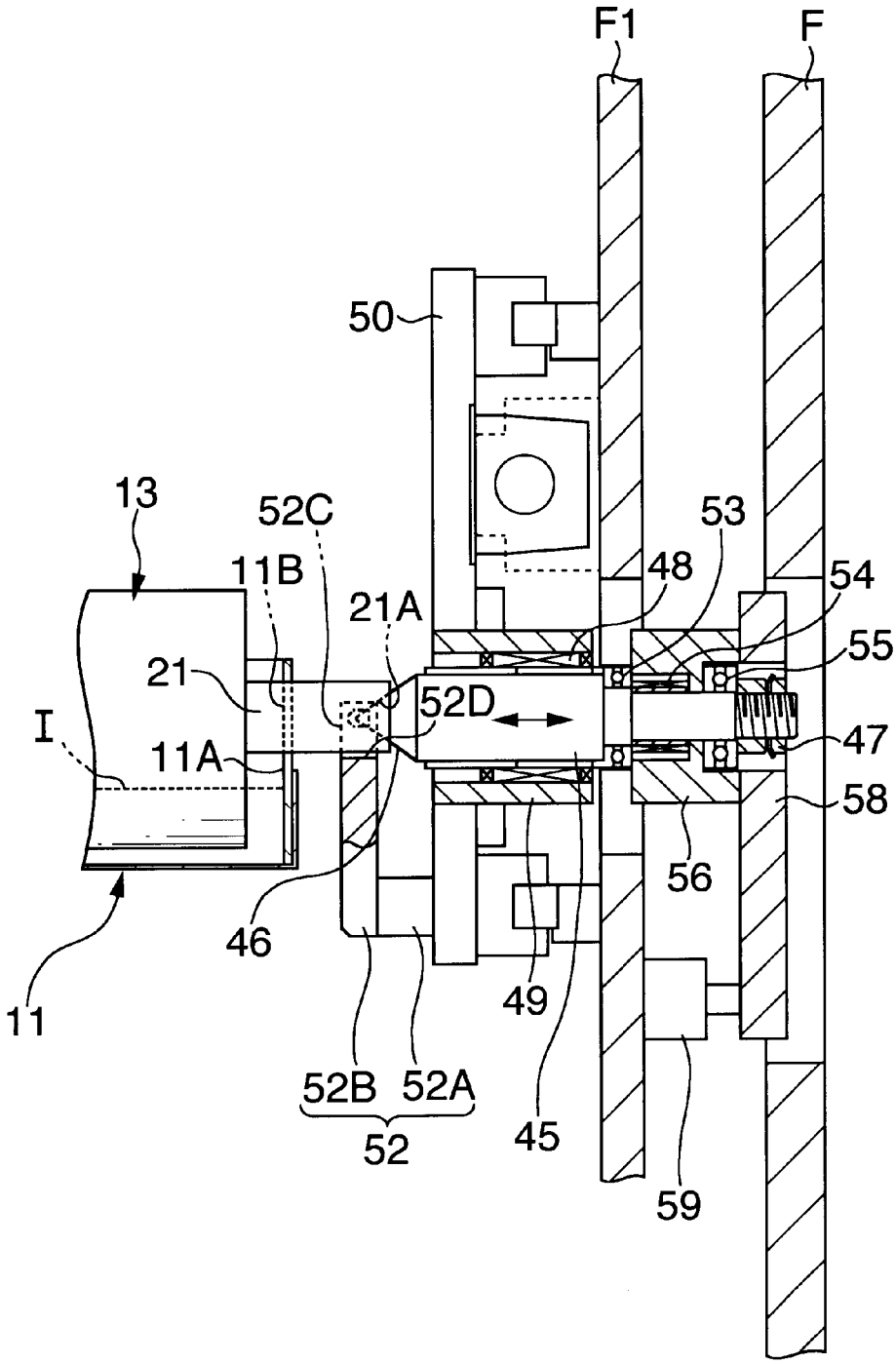
FIG. 4 is an enlarged cross section view of a right side region of FIG. 2.

The above-mentioned motor 30 is supported by a support plate 38 via a retaining shaft 33. The support plate 38 is provided on the interior surface side of the frame F. On the other hand, the above-mentioned rotating shaft 32 is rotatably provided on a bearing case 35 via a bearing 36. The bearing case 35 is positioned on the outer peripheral side of the rotating shaft 32. The bearing case 35 is supported by the support plate 38. A support arm 40 having a substantially L-shape is provided on the lower end side of the support plate 38 in FIG. 2. The support arm 40 includes a horizontal portion 40A and a standing portion 40B which extends upward from the tip of the horizontal portion 40A. A branching portion 40C is formed at the upper end of the standing portion 40B. The branching portion 40C bifurcates, and is substantially U-shaped. The support shaft 20 of the fountain roll 13 is positioned in the branching portion 40C. When a cylinder 59 serving as urging means urges the cone-shaped portion 34 to be closely fitted in the conical groove 20A of the support shaft 20 and supports them, a small clearance is formed between the support shaft 20 and a bottom surface 40D of the branching portion 40C. On the other hand, when the support shaft 20 is removed from the cone-shaped portion 34, the bottom surface 40D of the branching portion 40C receives the support shaft 20 so as to prevent the support shaft 20 from falling down The other end side of the support shaft 21, which is positioned on the right side of the above-mentioned fountain roll 13 in FIG. 2 and FIG. 4, is supported by a moving shaft 45 which is movably provided along the axis line of the support shaft 21. A coneshaped portion 46 is integrally formed at the tip of the moving shaft 45, i.e., at the left end of the moving shaft 45 in FIG. 2. The tip of the cone-shaped portion 46 is fitted in a conical groove 21A formed in the end surface of the support shaft 21.

The above-mentioned moving shaft 45 is rotatably supported on the inner periphery of a bearing case 49 via a bearing 48. Meanwhile, the bearing case 49 is attached to a support plate 50 disposed on the interior surface side of an interior frame F1. A support arm 52, which is substantially L-shaped, is provided on the lower end side of the support plate 50 in FIG. 2 and FIG. 4. The support arm 52 and the above-mentioned support arm 40 are substantially symmetrical. The support arm 52 includes a horizontal portion 52A and a standing portion 52B which extends upward from the tip of the horizontal portion 52A. A branching portion 52C is formed at the upper end of the standing portion 52B. The branching portion 52C bifurcates, and is substantially U-shaped. The support shaft 21 of the fountain roll 13 is positioned in the branching portion 52C. When the cone-shaped portion 46 of the moving shaft 45 is pressed and fitted in the conical groove 21A by an urging force of the cylinder 59, a small clearance is formed between the support shaft 21 and a bottom surface 52D of the branching portion 52C. On the other hand, when the urging force of the cylinder 59 is cancelled, and the support shaft 21 is removed from the cone-shaped portion 46, the bottom surface 52D of the branching portion 52C receives the support shaft 21 so as to prevent the support shaft 21 from falling down.

Figure 5:
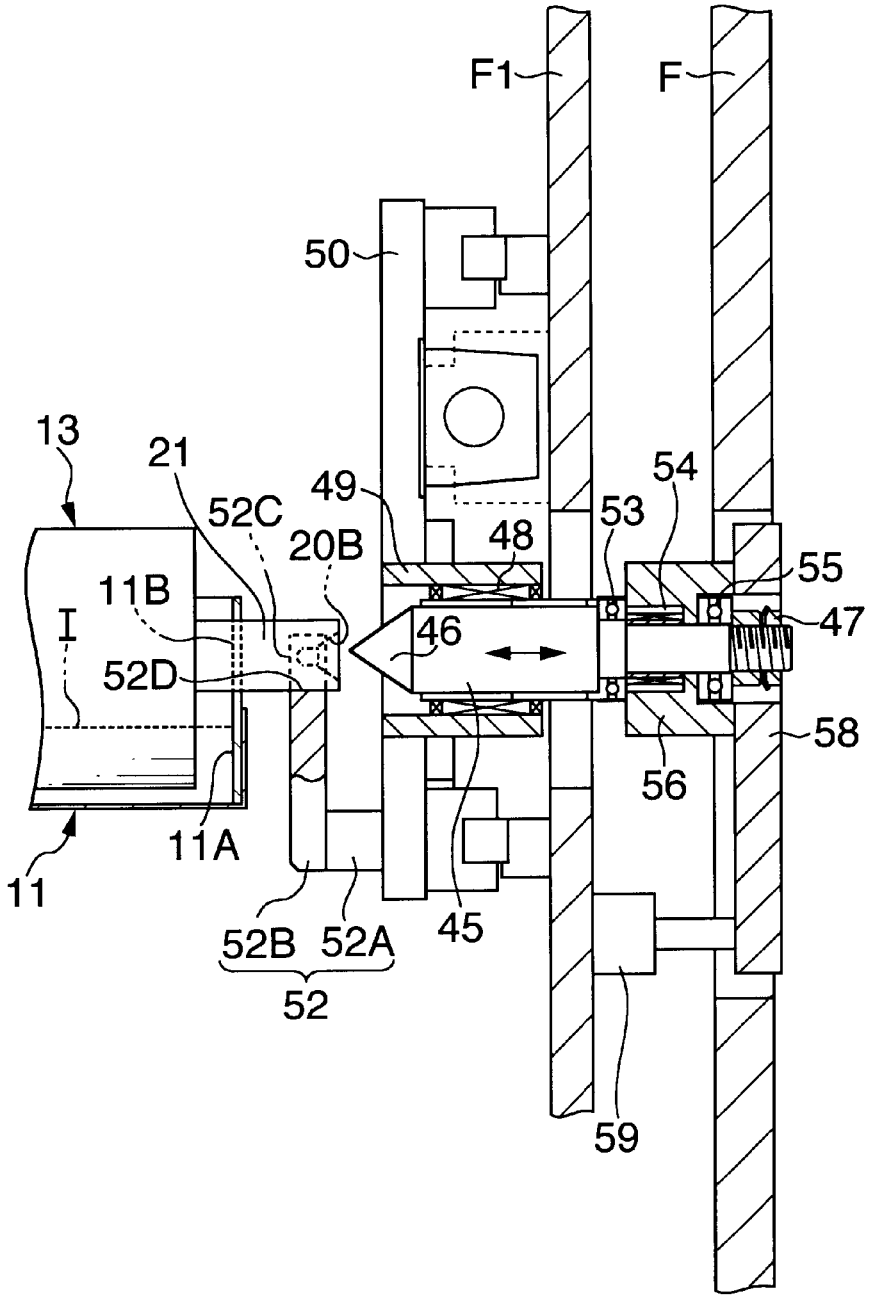
FIG. 5 is an enlarged cross section view of a right side region, which shows a state in which support by a moving shaft is released.

A bearing case 56 for retaining bearings 53, 54, 55 are provided on the outer periphery of the right side of the above-mentioned moving shaft 45 in FIG. 2 and FIG. 4. A coupling plate 58 is provided at the right end of the bearing case 56. The coupling plate 58 is coupled to the cylinder 59 such that the coupling plate 58 can be advanced and retracted in the axial direction. The cylinder 59 and the above-mentioned moving shaft 45 constitute urging means. A nut member 47 for enclosing the bearing 45 is provided around the moving shaft 45 on the inner peripheral side of the coupling plate 58. Therefore, when the above-mentioned moving shaft 45 is moved to the right side in FIG. 2 by operation of the cylinder 59, the support shaft 21 loses support by the cone-shaped portion 46. This permits removal of the fountain roll 13. At this time, the support shaft 21 is retained on the bottom surface 52D of the branching portion 52C of the support arm 52, so that the support shaft 21 is prevented from falling down (see FIG. 5).

When another fountain roll is used after the fountain roll 13 is removed, the other fountain roll is disposed such that both end sides of the support shaft 20, 21 are received by the above-mentioned bottom surfaces 40D, 52D of the horizontal arms 40A, 52A. Accordingly, when the above-mentioned moving shaft 45 is advanced, the fountain roll 13 can be centered and supported.

In the illustrated embodiment, only the support structure for the fountain roll 13 is shown. The anilox roll 15 in the present embodiment is also rotatably supported by using the same support structure for a support shaft 60 thereof (see FIG. 1). The fountain roll 13 and the anilox roll 15 each can be rotated by an independent motor 30 without using an interlocking mechanism such as gears.

Although the plate cylinder 16 and the platen 17 are omitted in the figures of the embodiment, they are interlocked with each other via gears at one end of each of support shafts 16A, 17A. However, in the present invention, the same support structure as that for the fountain roll can be employed for the plate cylinder 16 and the platen 17.

In addition, although both end sides of the support shaft 20, 21 are supported by the cone-shaped portions 34, 46 in the above-mentioned embodiment, one end side thereof may be removably retained by a scroll chuck or the like. Furthermore, according to the present invention, it is also possible to employ a construction in which at least one of the fountain roll 13 and the anilox roll can be attached and removed easily according to the above-mentioned support structure.

As described above, according to the present invention, the fountain roll and anilox roll each can be attached and removed easily and quickly. Therefore, efficiency of the operation required for changing ink color or printing accuracy can be significantly improved as compared with a conventional structure.

In addition, the coupling means for coupling one end side of the above-mentioned support shaft to the above-mentioned rotating shaft includes the first and the second coupling means, the coupling hole formed in any one of the first and the second coupling means, and the shaft member which is fixed to the other of the first and the second coupling members, and which is fitted into the above-mentioned coupling hole. Therefore, when the fountain roll and/or the anilox roll is removed, the coupling of the support shaft and the rotating shaft can be released simply by moving the first and the second coupling members such that they are separated from each other. Thus, the roll replacement can be performed easily and quickly as compared with a conventional structure.

Further, the above-mentioned urging means includes the moving shaft that is movable in the axial direction, and the moving shaft and the above-mentioned rotating shaft each have the cone-shaped portion at the tip. Therefore, centering of the fountain roll and the like can be performed with high accuracy.

Furthermore, when one end side of the above-mentioned fountain roll and/or the anilox roll is supported by a chuck, it is also possible to reduce the installation cost by using the existing structure.

What is claimed is:

1. A roll support structure of a printing device including a fountain roll disposed such that an outer peripheral surface thereof faces an interior of an ink pan, an anilox roll disposed so as to contact the outer peripheral surface of the fountain roll, a plate cylinder to which ink transferred to the anilox roll is transferred, and a platen disposed so as to face the plate cylinder, the roll support structure being arranged such that one end side of a support shaft of the fountain roll and/or the anilox roll is removably coupled to a rotating shaft for transmitting a predetermined rotating force, while the other end side thereof is supported via urging means that is movable in an axial direction.

2. The roll support structure of the printing device according to claim 1, wherein one end side of the support shaft and the rotating shaft are coupled together via coupling means, and the coupling means includes first coupling means fixed on an outer periphery of the support shaft, second coupling means fixed on an outer periphery of the rotating shaft, a coupling hole formed in any one of the first and the second coupling means, and a shaft member which is fixed on the other of the first and the second coupling means, and which is fitted into the coupling hole.

3. The roll support structure of the printing device according to claim 1, wherein the urging means includes a moving shaft that is movable in an axial direction, and the moving shaft and the rotating shaft each have a cone-shaped portion at a tip thereof, which can be fitted in an end surface of the support shaft of the fountain roll and/or the anilox roll.

4. The roll support structure of the printing device according to claim 1, wherein one end side of the support shaft of the fountain roll and/or the anilox roll is supported by a chuck.

* * * * *